United States Patent [19]

Fontana

[11] Patent Number: 4,635,905

[45] Date of Patent: Jan. 13, 1987

[54] RACETRACK CONVERTIBLE GUARDRAIL

[76] Inventor: Richard Fontana, 8525 Bella Vista, Alta Loma, Calif. 91701

[21] Appl. No.: 780,010

[22] Filed: Sep. 25, 1985

[51] Int. Cl.[4] ..... E04H 17/14

[52] U.S. Cl. ..... 256/65; 256/59

[58] Field of Search ..... 256/59, 65, 67

[56] References Cited

U.S. PATENT DOCUMENTS

| | | | |
|---|---|---|---|
| 3,374,986 | 3/1968 | McElroy et al. | 256/59 |
| 4,443,002 | 4/1984 | Fontana | 256/59 |
| 4,556,201 | 12/1985 | Turner | 256/59 |

FOREIGN PATENT DOCUMENTS

| | | | |
|---|---|---|---|
| 974055 | 11/1964 | United Kingdom | 256/59 |

*Primary Examiner*—Andrew V. Kundrat

*Attorney, Agent, or Firm*—George F. Bethel; Patience K. Bethel

[57] ABSTRACT

A racetrack convertible guardrail is disclosed herein which includes a plurality of spaced apart upright curved posts or stanchions. The curved posts or stanchions serve to support a racetrack rail which can be formed of metal or wood. Overlying the rail and the stanchions are a continuous number of sheets interfacing with each other to cover the stanchions and the rail for protection of a rider and a horse. Underlying the rail, stanchions and the protective cover is a second rail in the form of tubing or other rail forms supported by a hinged arm that can be utilized for sulky racing. The rail forms are supported by means of collars that are in turn supported by the hinged arm that underlies the stanchion. The collar and the tubing or rail forms can be connected to another form of stanchion that has a stake for supporting the stanchion, rail and tubing with the collars for purposes of grass racing and which can be removed by moving said stake and other components of the rail.

22 Claims, 8 Drawing Figures

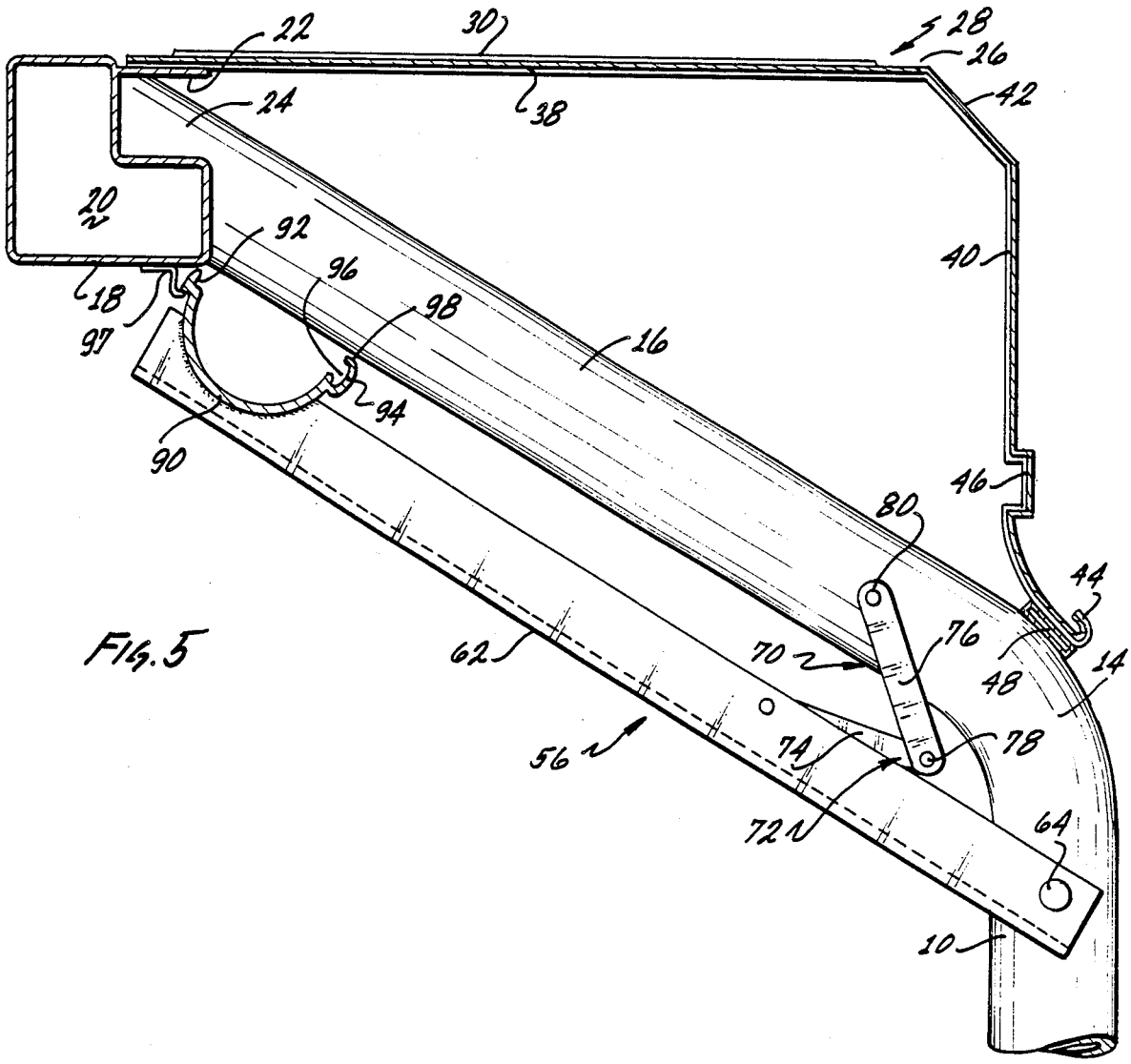
FIG. 5
FIG. 6
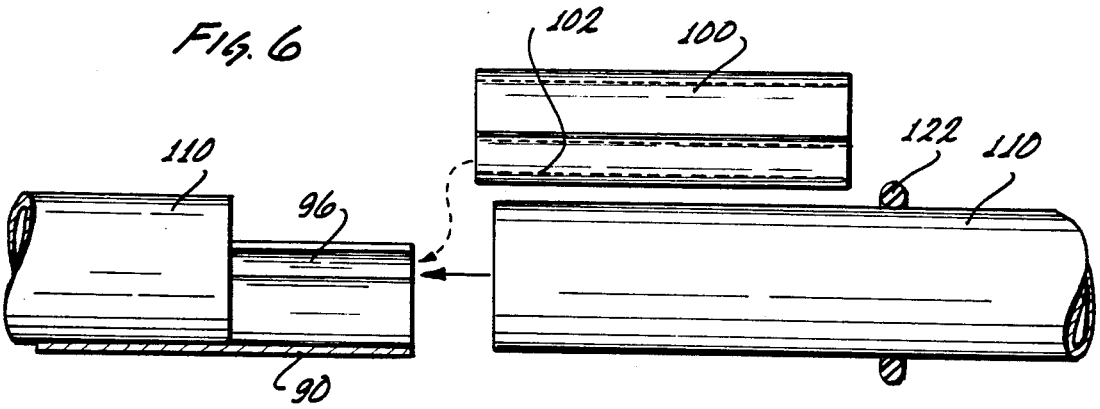

RACETRACK CONVERTIBLE GUARDRAIL

FIELD OF THE INVENTION

The field of this invention lies within the horse racing art. In particular, it lies within the art of guardrails for horses on tracks that can be dirt tracks used for thoroughbred racing. It also lies within the area of horse racing that utilizes rails for protection of racers in sulky racing. In addition thereto, it addresses the field of horse racing on grass, where grass tracks are utilized with protective railings.

THE PRIOR ART

The prior art of rails for horse racing involves generally fixed rails. The rails extend around the inside of the track. They are usually comprised of a stanchion or post. The stanchions or posts are curved and support a rail which extends around the inside of the track. This rail is the rail which guides the horses and the riders around the extent of the track.

Recently, the inventor hereof has substantially improved the state of the art by providing a rail with a substantial safety feature. The safety feature is in the form of a series of elongated protective panels. The elongated protective panels extend between the posts on the rail and serve to cover the post and rail.

The foregoing post and rail covering can be exemplified by the inventor's U.S. Pat. No. 4,443,002, issued Apr. 17, 1984. It can be seen therein that the inventor has invented an elongated series of panels that are shaped to fit over the stanchions or posts and rail. This serves to protect the riders and horses from falling into the stanchions or the curved portion thereof and becoming severely injured.

The foregoing invention was an advance over the art cited therein, including the U.S. patents incorporated herein by reference as prior art that were cited in that patent.

This invention directs itself to not only a protective rail and stanchion or post configuration, but the convertibility of such tracks equipped therewith and with a standard post and rail to other types of tracks. In particular, it addresses itself to the utilization of the posts and rails of a regular track in conjunction with a second system for providing sulky racing.

In the past, sulky racing has had to use a particular type of rail different from the type used for regular horse racing. This, of course, presented problems with regard to changing one track rail to another.

There have also been attempts at changing the track rail of a standard racehorse track to another. Such activities have not met with a great degree of success. Generally, the tracks have to be such wherein they incorporate two different types of rails, or two different types of tracks have to be established. Also, existing art demands that one particular rail be removed or be supplemented with another in an incompatible manner in order to provide horse racing and sulky racing on the same track.

This invention is directed toward allowing for convertiblity of a standard racetrack into a sulky racetrack by merely lowering an arm that is pivoted on a pair of support brackets. The arm moves upwardly and downwardly on the post underneath the rail and protective cover. At the end of the arm is a semicircular collar with splines and channels on the edge regions thereof. The splines and channels on the edge regions receive a second semicircular collar thereover in relationship therewith in order to hold a rail. The rail can be in the form of pipes or rails that extend into the two semicircular collars in mated abutting relationship.

When the semicircular collars have been implaced, they hold the pipe or rail with the arm and the depending brackets holding the arm outwardly. The entire structure can then be used as a sulky guide rail extending from a standard horse racing rail. This is an advance over the art, inasmuch as it can be used at any particular time by merely lowering the arm and inserting the pipes into the collars which form the rail around the length of the track.

In addition to the foregoing, there has been a form of grass track horse racing over the years. The grass track racing has generally incorporated rails that can be moved to avoid wearing the turf in one spot. Also, there are portable fences that have significant moving costs attendant therewith, in order to move them into different areas on a grass track.

It is oftentimes customary to have a grass track with portable rails moved to different locations in order to prevent the turf of the grass track from being unduly trod upon in one particular location on a constant basis. This is accomplished by means of moving the rail inwardly and outwardly around the track and providing for different locations on the grass.

During the movement of such rails and fencing, it becomes a complex situation to disassemble the rails, move them and set them up again. This invention overcomes the foregoing complexity by providing movable stakes which can be pounded into the ground and are such that they support a series of pipes or rail tubing on the stanchions or posts. The grass track rail tubing is supported in the same manner as the prior described sulky tubing on the stanchions or posts. This is accomplished by having a semicircular collar attached to a stanchion. A second semicircular collar fits over the first collar and receives pipe rail therein in order to form a completed rail for a grass track.

The stanchions are supported on the stakes which are driven into the ground. The stakes have a specific configuration to prevent the discoloring of grass thereunder so that horses are not frightened by seeing whitened spots or dead spots of grass when they are racing in an area which had previously had stakes driven thereunder.

As a consequence, this invention not only provides for portability and movement of grass tracks but also enhancement of regular tracks for sulky racing. As a consequence, it is a substantial improvement over the art and as will be seen in the following specification, has a significant degree of patentability attendant therewith.

SUMMARY OF THE INVENTION

In summation, this invention comprises an improved horse racing rail that can be used interchangeably for thoroughbred track racing, sulky racing, and incorporates interchangeable elements for grass track racing.

More particularly, it incorporates a post or stanchion that is a normal horse racing stanchion that supports a rail around the inside of a track. The stanchion and rail can be optionally covered by a safety panel that is known in the prior art through the development of the inventor hereof.

Extending from the stanchion or post is a pivotal arm. The pivotal arm can swing from the upper inside portion of the stanchion or post at the curved portion thereof downwardly and be supported by two pivotal brackets. The arm supports a first semicircular collar. The first semicircular collar on the arm receives a second semicircular collar thereover. Between the two semicircular collars, a section of pipe or rounded rail can be inserted. This pipe or rounded rail is secured therein and serves to provide a rail on the inside of the track at a lowered area for sulky racing. The sulky rail and support when not in use is removed and the arm is swung upwardly into the underportion of the optional panel and the stanchion. This provides for disposal or stowing of the sulky rail support so that the upper rail of the track can then be used for normal racing purposes.

The combination of the two respective semicircular collars can be utilized in conjunction with a stanchion supported on a stake. The same tubular or circular pipe or rail can be fitted into the semicircular collars and held by the stanchions. This effectively provides for a support thereof on the stake so as to avoid duplication of rails between grass track racing and sulky racing. In addition thereto, the stake can be moved on a grass track that supports the stanchions and rails in an effective manner to avoid undue wear on the grass track.

Thus, the entire invention can be used with the interchangeable parts hereof to provide normal horse racing, sulky racing, and grass track racing in an easy and facile manner.

BRIEF DESCRIPTION OF THE DRAWINGS

The invention will be more clearly understood by reference to the description below taken in conjunction with the accompanying drawings wherein:

FIG. 5 shows a view of the sulky rail and pivotal support arm when it is not in use and folded up under the stanchion or posts.

FIG. 6 shows a view of the sulky rail semicircular collars that support and surround the elongated pipe or rail with the top semicircular collar covering the rail and being implaced therein with the pipe or sulky rail.

DESCRIPTION OF THE PREFERRED EMBODIMENTS

Figures 1, 3:
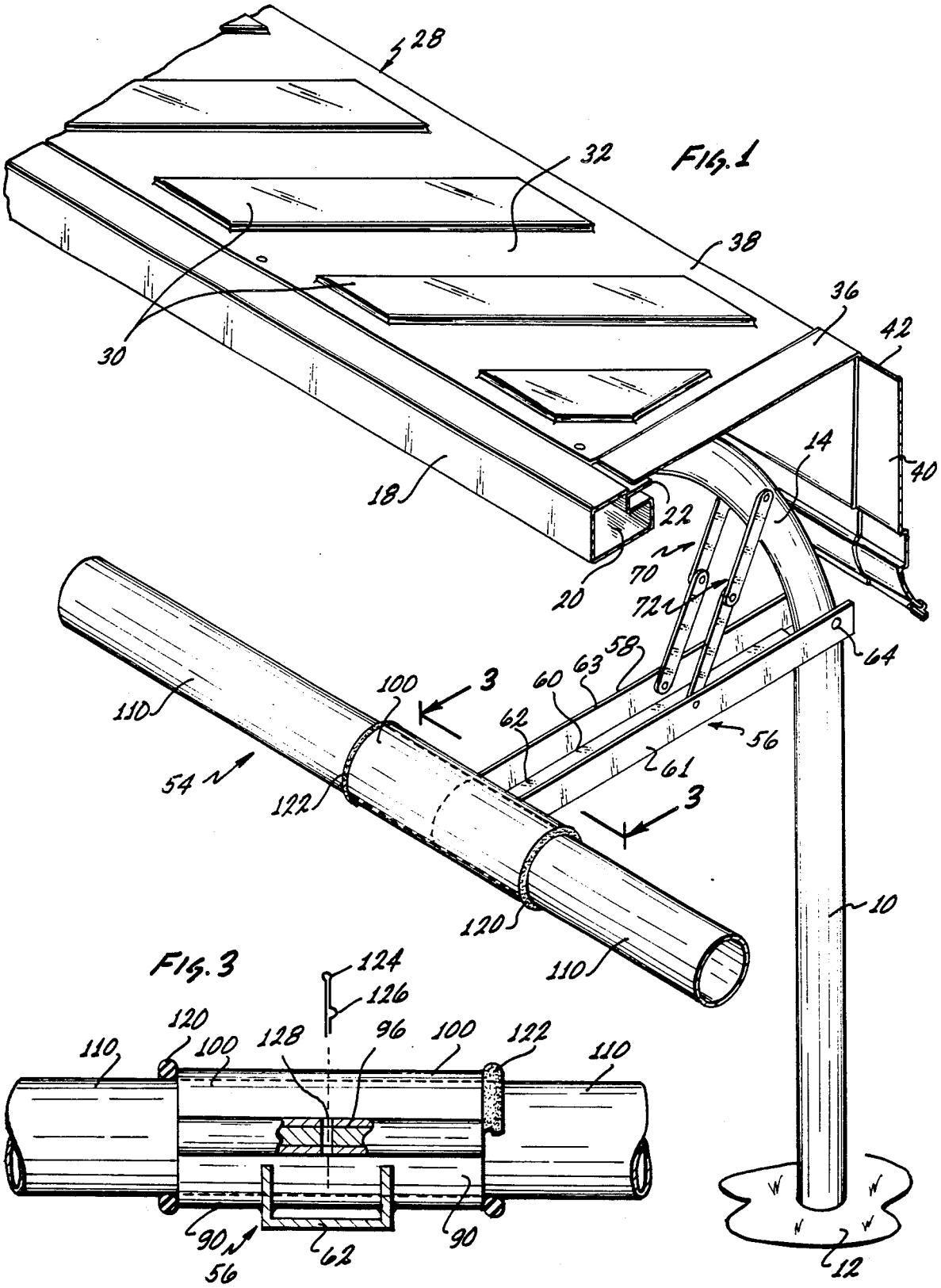
FIG. 1 shows a perspective view of a racetrack rail of this invention incorporating the sulky rail supported on the pivotal arm with the semicircular collars and the tubing or rail within the sulky rail support.
FIG. 3 shows a sectional view as fragmented in the direction of lines 3—3 of FIG. 1 of the semicircular collar connection means for the sulky rail of this invention.

FIG. 1 shows a perspective view of a section of the protective racetrack rail of this inventon that incorporates the sulky racetrack rail therewith. Looking more particularly at FIG. 1, it can be seen that a stanchion 10 or post has been shown implaced within the ground 12. The stanchion 10 or post can be implaced in any particular manner, such as being driven into the ground on a permanent basis or set in concrete or other permanent means. It can also be implaced in the ground 12 by a temporary securement, such as a post or fitting, over which the stanchion 10 is set or secured to such as that exemplified in FIGS. 7 and 8.

Figure 2:
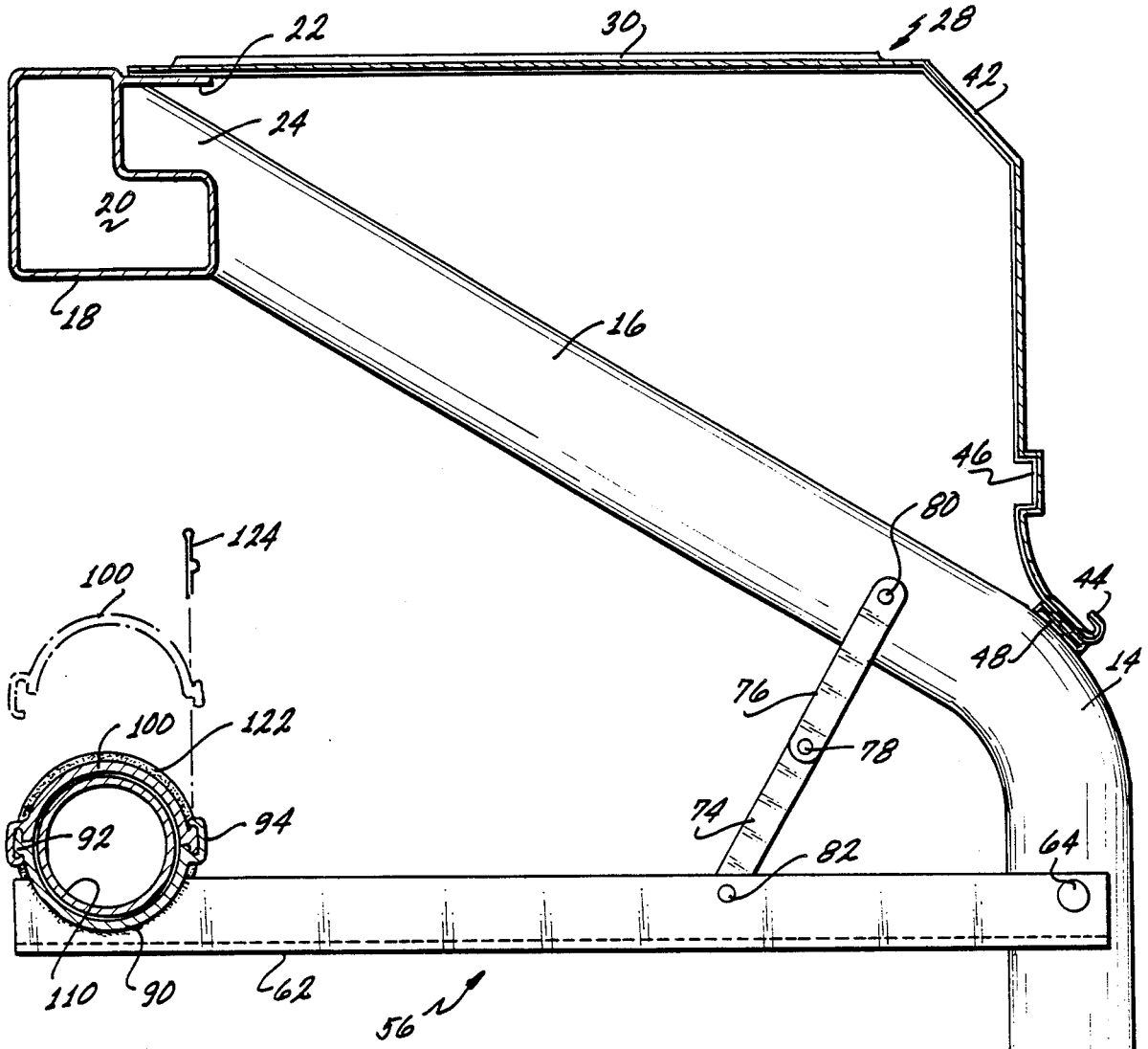
FIG. 2 shows a side elevation view that has been sectioned and a portion of the semicircular rail support collar has been shown in removed orientation for explanatory purposes.
Figure 4:
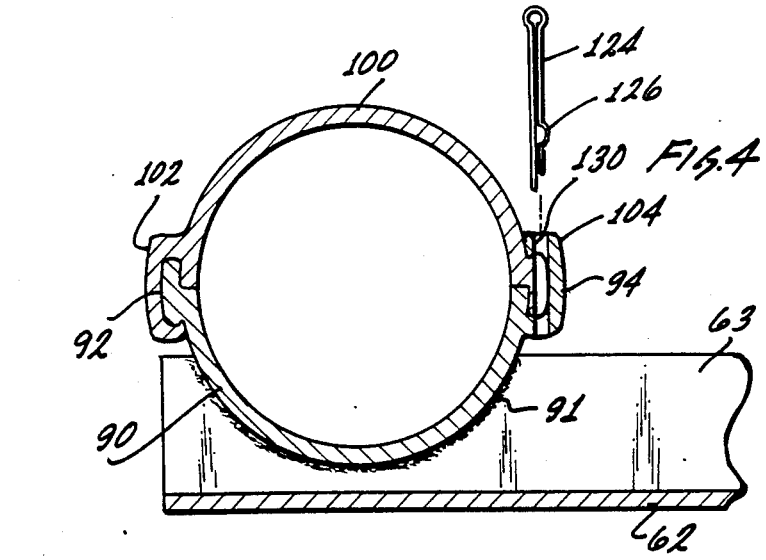
FIG. 4 shows a sectional and fragmented view of the detail of the semicircular coupling means for the sulky rail as sectioned through the midline of the showing of FIG. 3.

The stanchion 10 curves upwardly in a generally curved section 14 into an angularly bent portion 16 that can be seen more specifically in FIG. 5 and FIG. 2. This upwardly extending angular portion 16 can be in any particular configuration. It is not necessary that it angularly extend in the manner shown or the bend 14 in the stanchion be incorporated in the foregoing manner. In effect, the stanchion 10 can be bent with a double gooseneck, or bent in a multitude of sections or curved continually in any manner to allow for the bending over for implacement of a rail at the end thereof.

Looking more particularly at the figures, it can be seen that a rail 18 is shown. The rail 18 has an L shaped hollow cross section with a space 20 within the L shaped cross section. The rail 18 is formed from an extrusion of aluminum or any other suitable material. Extending from the upright portion of the L, is a flange or ledge 22. This flange or ledge 22 creates a space 24 between it and the lateral portion of the L shaped member.

The rail 18 can be substituted by any other suitable rail. In the prior art, it has been known that rails made of wood have been utilized, such as in the inventor's prior patent. Thus, it is readily seen that wood and metal rails of all types and other configurations can be used to provide the rail function of rail 18. Furthermore, a plastic rail can be utilized formed of any particular material attached to the post or stanchions 10 in any particular manner.

The rail 18 with the flattened ledge or flange 22 supports a panel 28. The panel 28 is shown having an upper surface with a plurality of diagonal guides 30. The diagonal guides 30 are raised bosses or strips on the surface of the panel 28. The raised bosses or strips on the surface of the panel 28 provide for channels 32 between the guides 30. The purpose of the guides 30 is to guide an object over the surface thereof angularly out into the field when impact takes place. It is felt that the guides 30 with the channels 32 therebetween tend to guide a rider or horse or other object when impacting the panel in the direction of the infield of the track.

Each panel 28 is formed in a section so that it spans the respective space between the stanchions 10. The panel 28 in this particular instance is shown as a panel with a joindure lip 36. The joindure lip allows for the insertion of an adjacent panel next to it in mating configuration, so that it fits between the space of the joindure lip 36 and the top of the ledge or flange 22. The joindure lip 36 can be in the form of any suitable expansion or offset ledge allowing for a mating panel member to be slid thereunder. Each panel member has a lip or ledge 36 at one end thereof, to allow for an adjacent panel to be slid thereunder or be mated therewith.

The panel 28 is comprised of an L shaped member formed of a plastic. The L shaped member has one portion in the form of a lateral portion 38 which terminates in an upright portion 40. Between the lateral portion 38 and upright portion 40 is an angular corner section 42. The angular corner section 42 provides rigidity and reinforcement as well as a more resilient surface when an impact takes place. The panel in the form of the upright portion 40 terminates in a turned back end 44 and has a reinforcing boss or ridge 46 therein. The panel 44 at the end thereof is attached to the post or stanchion 10 by means of a connector 48. The connector can be in the form of any suitable connection means for securement such as bolts, metal screws, adhesives, plastic connectors, rivets, or any other suitable fastening menas.

Beneath the panel 28 is a railing assembly 54. The railing assembly 54 swings down on a pivotal arm 56. The pivotal arm 56 is comprised of a channel arm member 58 having a channel conformation or groove 60 between two upright walls 61 and 63, and a bottom portion 62. The bottom portion 62 and the upright walls serve to form a U shaped channel.

The U shaped channel forming the arm 56 is pivotally connected by means of a bolt 64 to the stanchion 10. The bolt 64 can be substituted by means of a rivet, plastic snap connector, screw, rod, or any other suitable means for allowing the arm 56 to be pivoted on the stanchion 10. In order to enhance the pivoting, a cutout portion of the base 62 is provided so that the ends of the walls forming the U shaped member can be attached by the bolt or rod 64 to the stanchion 10.

The specific configuration of the pivotal arm 56 allows for the arm to be dropped down from beneath the panel. In order to support and guide the arm, two sets of brackets are utilized. The brackets are pivotal securement or holding brackets 70 and 72. The holding brackets 70 and 72 each comprise a lower portion 74 connected to an upper portion 76. They are interconnected by means of a pin, bolt or rivet 78. The upper portion or upper arm 76 of the bracket is connected to the angular portion 16 of the stanchion 10 by means of a bolt, rod or screw 80 that allows the upper arm 76 of the bracket to pivot therearound. The lower arm portion of the bracket 74 is connected to the pivotal arm 56 by means of a bolt, rod or screw 82 passing from the lower portion 74 through the upright walls 61 and 63 on either side of the arm 56.

The foreoging configuration permits the arm 56 to be raised and lowered by any suitable means to allow for positioning of the pivotal arm 56 in a generally outstretched manner from the stanchion 10. This outstretched manner is generally shown as effectuating a horizontal relationship normal to the upright portion of the stanchion 10. However, as can be appreciated, any particular angular configuration of the positioning of the arm 56, which is sufficient to provide the functions hereof, can be used. It is not necessary to position it in a horizontal manner, or in the normal manner from the stanchion 10.

The arm 56 serves to support a lower first or semicircular collar 90. The collar 90 is formed in a manner so that it has an offset flange or L shaped ridge 92 and a channel member 94. The channel member 94 is provided along the edge of the collar 90 and forms an interior opening thereof having an interior channel surface matching the ridge or flange 92. The interior opening can be seen more clearly in FIG. 5 wherein the channel member 94 can be seen with an opening or passage between the channel walls. The channel member 94 is formed with a hooklike portion 98 which bends backwardly and inwardly to provide the groove or opening 96 in the channel member 94. The foregoing is fundamentally the reciprocal of the flange 92 that can be seen so that it can be formed and mated within the opening 96. In this manner, it can receive a like semicircular collar 100 slipped into relationship therewith, so as to be mated and provide a complete encapsulation of a member between both collars.

As can be seen, a semicircular collar 100 is shown having a channel member 102 analogous to channel member 94 and a flange 104 analogous to flange 92. The foregoing respective flanges and channels mate with each other and are reciprocal so that one can be used as a bottom portion or the top portion respectively, enabling easy and facile manufacture of the entire rail assembly. The two parts are formed from one aluminum extrusion, enabling one part to serve both functions. Any particular flange, channel, chamfer, receipt, lock fitting, cam lock, buckle, hinge, snapover arrangement or other means can be used in order to provide the holding of the two respective semicircular collars. Furthermore, any means can be utlized to function in place of the semicircular collars in generally analogous relationship for holding the rail, as will be described hereinafter.

Looking more particularly at FIG. 3, it can be seen wherein the collars 90 and 100 have been assembled. The lower collar 90 is welded or attached by any suitable means to the arm 56, so that it supports it. The overlying collar 100 is slid into place by means of matching the channel portion 102 to the flange 92 and the flange 104 within the channel member 94. They are slid together in the foregoing manner as can be seen within FIG. 6 whereby they come together in a mating manner in order to hold the rails, as will be detailed hereinafter.

Looking more particularly at the rails, it can be seen that tubular pipelike portions 110 are shown. These tubular pipelike portions 110 roughly correspond to the same distance as the panels 28 and span the area between the stanchions 10. They are inserted in generally abutted relationship as can be seen in FIG. 3. The abutted relationship provides for an implacement of the rail formed of the pipe 110. The rail formed of the pipe 110 allows for continuity and configurative rail patterns all the way around the track at a height lower than the upper rail 18. Thus, it accommodates sulky races on a track.

The configuration of the collars 100 and 90 can be of any suitable configuration generally matching the rail 110 formed of the pipe. Thus, if the pipe that forms the rail is square, ogive, semicircular, or of any other cross section, the collar 90 and 100 should match the cross section in order to accommodate and allow for the holding thereof in juxtaposition to the interior dimension within the collars 90 and 100. Thus, the inside configuration and dimensions of the collar should generally be configured to conform to the pipe or rail outside configurations and dimensions in order to allow them to seat therein.

In order to allow for a smooth transition area between the pipe 110 and the collars 90 and 100, two O rings 120 and 122 are utilized. The O rings 120 and 122 are such wherein they allow for a smooth and elastomeric transition as far as the step or ledge goes between the outside dimensions of the collars 90 and 100 and the pipes 110. Thus, they provide somewhat of a protected surface. Any form of ring, collar, plastic clip, flange, or spline can be utilized in place of the O rings 120 and 122, the thought being that they should provide for less tearing and destructiveness of any object bumping into the interface of the collars 90 and 100 and the pipe 110. Also, the collars 90 and 100 can have a chamfered edge, rather than having the covering. They can taper and fair downwardly circumferentially or have a fillet toward the pipe 110 or have any other conformation which allows for a smooth transition between the two respective portions of the collars and pipe.

In order to hold the collars together, a pin, such as a cotter pin 124 is shown. The pin has a protuberance 126 which allows it to be implaced within an opening 128 of the collar members 92, 94 and 102 and 104. This opening can be seen as an opening 130 into which the pin 124 passes into the opening of the flange and channel of the collar. Thus, the collars 90 and 100 are attached to each other on a removable basis and can be held so that they do not slide backwardly and forwardly by virtue of the relationship of the pin 12 holding them against longitudinal movement with respect to each other. Any particular type of attachment can be utilized in order to secure the collars together in overlying relationship. Suffice it to say, one should not slide with respect to the other.

The lower collar 90 has been shown welded or affixed to the arm 56 by means of a weldment. However, any other suitable attachment can be utilized whereby the weldment 91 can be substituted by an overlaying fit, notches, mating grooves, splines, bolts, rivets, or other means securing the collar 90 to the arm 56.

Figures 7, 8:
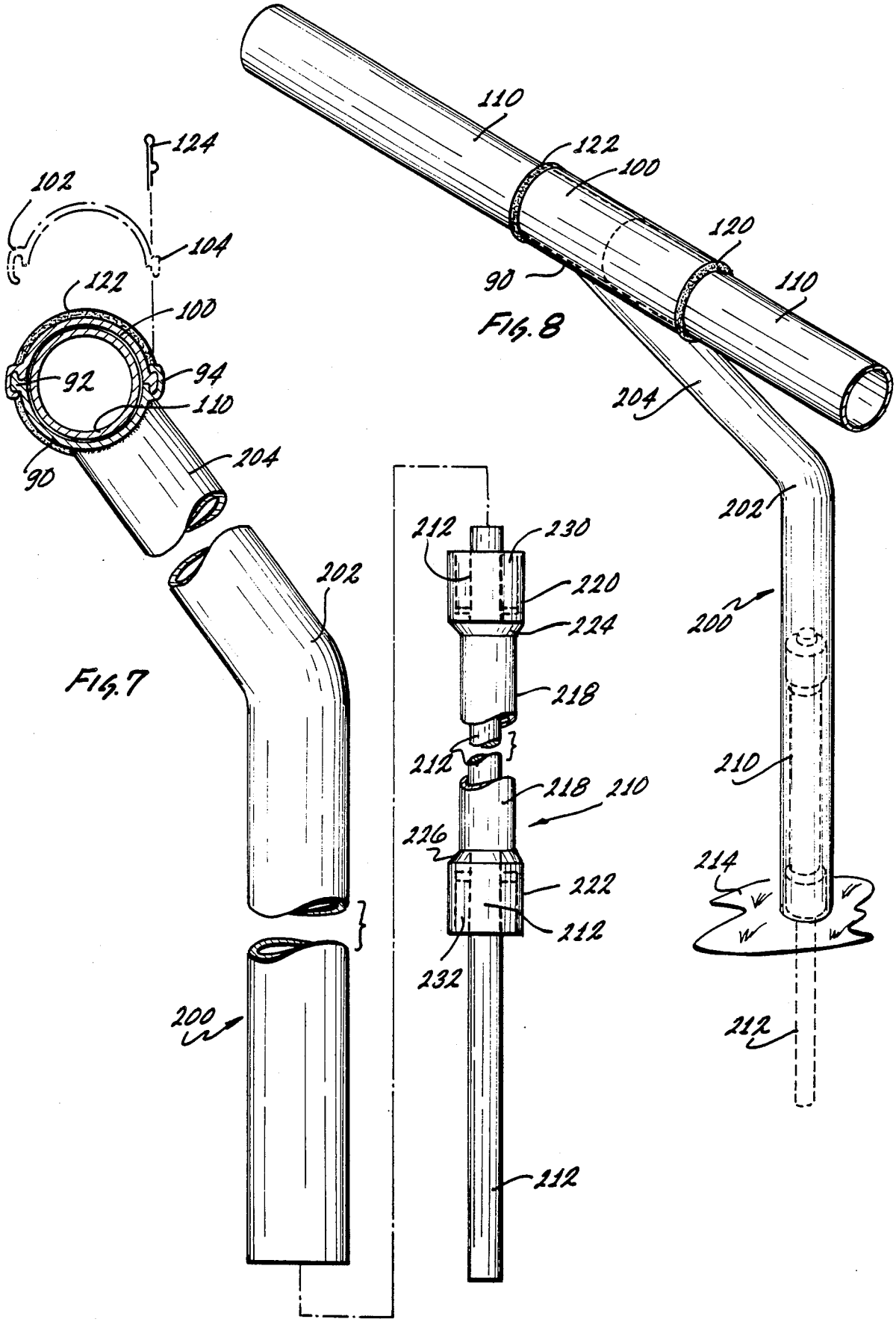
FIG. 7 shows a fragmented view of the stanchion and pipe support of this invention for grass track racing.
FIG. 8 shows a view of the stanchion and support with the rail in place for grass track racing.

Looking more particularly at FIGS. 7 and 8, it can be seen that another stanchion 200 is shown with a bend 202 terminating in an upper angular portion 204. The upper angular portion 204 receives a collar portion such as the lower collar 90. The upper collar portion 100 is shown overlying the lower collar portion 90 and can be implaced in the same manner as the prior embodiments. In this manner, the channel member 94 and flange 92 can receive the upper channel 102 and flange 104. Also, the pin 124 that is used to secure the previous upper collar member 100 to the lower collar member 90, can be utilized.

The weldment 91 welding the lower collar 90 to the arm, can be utilized to weld the lower collar to the angular portion 204, or any other suitable connection means can be utilized. Suffice it to say, the interchangeability of parts between the two respective collars 90 and 100 is analogous to the previous utilization whereby each respective channel or collar member was formed so that the reverse thereof allows it to be such wherein it engages the other channel member or collar.

Various configurations can be utilized in the way of cross sectional configurations of the collar in order to meet any outside cross sectional dimensional aspects of the pipe 110 or rail that is used. In this particular case, the pipe 110 has been shown as the rail seated within the upper and lower collar members 100 and 90. Also, the utilization of the O rings 120 and 122 are shown covering the ends of the upper and lower collars 100 and 90. However, the fairing, filleting or chamfering as in the prior embodiment, can be substituted for the O rings.

In order to mount the stanchion or post 200, a stake is shown, namely, a stake 210 is shown having a narrow rod portion 212 implanted in the ground 214. The stake 210 with the rod portion 212 has an outer pipe member 218 having an upper belled flange 220 and a lower belled flange 222. The belled-out portions terminate in shoulders 224 and 226. Each of the belled-out portions has a space respectively in the upper portion 230 and the lower portion 232 which allow the rod 212 to pass therethrough in spaced relationship. This spaced relationship is important as will be seen hereinafter.

The rod portion 212 is driven into the ground during grass racing. It can be used as a portable implacement for the stanchion 200 and effectively allows for the movable location of the track over a grass track area into various locations. Thus, the grass track can be implaced or located in any particular grass area and the stanchions 200 holding the rail 110 can be used in various locations. The only requirement is that the rod 212 forming the stake 210 be driven into the ground at a suitable location.

When the stake 210 is driven into the ground, the lower flange or bell portion 222 seats against the grass and allows the space 232 to permit the grass to grow up therein in a limited manner. This prevents the grass from being completely killed in that particular area to a significant degree. The killing of the grass would be more prominent if the space 232 were not utilized. Thus, the appearance of brown spots when the rail is moved is avoided in some measure. This is important on grass track racing, inasmuch as it can be a deterrent to horse racing because horses sometimes shy from spots on the ground.

The stake 210 can be moved at will to any particular location so as to allow the stanchion 200 to be moved with the rail support providing support for rails or pipes 110. This movement of the stanchion 200 is easily accomplished by merely lifting it over the bell portions 220 and 222 of the stake 210. The outer dimensions of the bell portions 220 and 222 generally conform to the inner dimensions of the stanchion such that the stanchion 200 can slip thereover. The stanchion should fit tightly over the bell portions 200 and 222, so as to not allow it to slip and move in a sloppy manner. However, there should be suitable clearance in order to pass the stanchion 200 thereover and withdraw it from the stake 210 when desired.

The foregong configuration allows for multiple uses of the pipe or other configuration of rail 110 forming the rail by being utilized for grass track and regular track uses with sulky racing. Furthermore, as can be seen, the interchangeability of the collars 90 and 100 provides for utilization of the collars and securement means between various tracks for both grass racing and for sulky racing and regular tracks. Thus, the entire interchangeability of the system allows for portabilty of race track rails on grass tracks, as well as accommodating sulky racing by lowering an arm 56 with the collars 90 and 100 for receipt of rails or pipes 110 to provide for the railings of a track. Additionally, it can be appreciated that various savings are accommodated in the manufacture, as well as the interchangeability of parts for the entire grass track and regular track racing.

When the arm 56 of the regular track is not in use, it can be tucked up under the panel 28 in any suitble manner such that a clip, such as clip 97, or other suitable spring means can be utilized to allow for the folding of the arm 56 upwardly. Also, a securement pin, bolt, latch, or screw can be utilized or any other means for holding the arm 56 upwardly against the bottom of the rail 18.

As can be appreciated, this invention has substantial utilization over the prior art in providing utility to rails for horse racing on both a regular track providing a rail that can be moved for a sulky race into position from a regular rail as well as providing interchangeability of the sulky rail with a grass track rail and other types of rail that are utilized with portable stanchions and stakes for holding the stanchions. As a consequence, this invention should be read broadly over the prior art.

I claim:

1. A improved racetrack rail comprising:
a post for placement within the ground:
a first rail for attachment to said post:
a second rail means adapted for connection to said post at a lower operative position from said first rail: and,
pivotal means attached to said post for moving said second rail to a position away from said lower operative position beneath said first rail.

2. The improved rail as claimed in claim 1 further comprising:
said post being curved at one portion thereof in the direction of said first rail.

3. The improved racetrack rail as claimed in claim 2 wherein said pivotal connection means comprise:
an arm connected to said post and adaptably connected to said second rail means; and,
pivotal support means for moving said arm from said operative position beneath said rail to said second position removed from said first position beneath said first rail means.

4. The improved racetrack rail as claimed in claim 3 wherein:
said second rail means is attached to said arm by means of a detachable collar.

5. The improved racetrack rail as claimed in claim 4 further comprising:
a second rail means formed as segments connected by said collar attached to said arm; and wherein,
said collar is formed of a first collar portion attached to said arm and an overlying second collar portion for receiving and holding said second rail means.

6. The racetrack rail as claimed in claim 5 wherein:
said first collar portion is provided with a channel and a spline and said second collar portion is provided with a channel and a spline for respectively mating in each other's respective channel and spline thereby forming a full collar.

7. The improved racetrack rail as claimed in claim 6 wherein:
said arm is pivotally connected by means of a pivotal bracket attached to said arm and connected to said post for holding said arm in extended relationship and allowing it to be moved from said first position under said first rail to said second position; and,
means for securing said first collar portion to said second collar portion.

8. The improved racetrack rail as claimed in claim 7 further comprising:
a panel extending from said first rail over said post.

9. The improved racetrack rail as claimed in claim 8 further comprising:
said panel formed as an inverted L shaped member having a first major surface overlying said post and connected to said first rail and a depending portion overlying the curved portion of said post; and wherein,
said panels are placed in adjacent relationship to each other as they extend around the racetrack course.

10. The racetrack rail as claimed in claim 9 further comprising:
a pin for securing said first and second collar portions together; and,
means for encircling the joindure between said racetrack rail and said collars.

11. An improved racetrack rail for use with harness or sulky racing and thoroughbred racing comprising:
a post forming a stanchion member having a curved portion thereto:
a rail for attachment to said post at the end of said curved portion:
a pivotal arm attached to said post having pivotal connection means:
a pivotal support means for holding said arm in an extended position from said post;
collar means attached to said arm: and,
a rail for receipt in said collar means adapted for pivotal underlayment beneath said first rail for providing a sulky racing rail when said arm is lowered into a position beneath said first rail.

12. The improved racetrack rail as claimed in claim 11 wherein:
said collar means receive rails therein in segments that can be removed from said collar means by withdrawal therefrom; and wherein,
said arm can be swung upwardly into a position underneath said first rail.

13. The improved racetrack rail as claimed in claim 12 wherein said collar means comprise:
a first collar member attached to said arm; and,
a second collar member adapted for receipt by said first collar member.

14. The improved racetrack rail as claimed in claim 13 further comprising:
a panel extending over said post and connected to said first rail and extending downwardly in part over said post at the curved portion.

15. The improved racetrack rail as claimed in claim 14 wherein:
said panel has a plurality of raised ridges diagonally formed on the upper major surface thereof.

16. The improved racetrack rail as claimed in claim 15 further comprising:
means for maintaining said collar members in connected relationship.

17. An improved grass track horse racing rail comprising:
a post having at least a hollow portion thereof:
an angled portion of said post:
a first collar member describing less than a full circle in circumference connected to said angled portion of said post;
a second collar member for overlying said first collar member having means for connection to said first collar member;
rail means for securement to said post between said first and second collar members; and,
a stake for implacement within the ground and receipt within the hollow portion of said post for holding said post in position.

18. The improved rail as claimed in claim 17 wherein:
said collar members comprise connection means that are matched to each other for receipt of each respective collar members.

19. The improved rail as claimed in claim 18 wherein:
said collar members have a flat flange and a channel respectively for receipt of an opposite channel and flange of the other collar member so that the flange of one collar member will be received in the channel of another; and,
means for holding said rails within said collar members.

20. The racetrack rail as claimed in claim 19 wherein said collar members comprise:

semicircular members having a channel extending along one edge and a spline along the other edge longitudinally thereof; and, said channels and splines are respectively matched in the first and second collars for implacement thereof and the holding of a rail therein.

21. The improved rail as claimed in claim 17 wherein:

said stake has a belled-out portion surrounding it that spaces said belled-out portion from the axis of said stake with a space therebetween, thereby providing a stop to the driving of said stake and a space for grass under said belled-out portion.

22. An improved racetrack rail system for use with grass tracks and a dirt racetrack comprising:

collar means formed as a split collar having longitudinal channel means on one edge of a first collar portion and a spline on the other longitudinal edge with a matching spline and longitudinal channel on a second collar portion so that said first and second collar portions can be connected by sliding each collar portion together by the first collar portion respective channel and spline being connected to the second collar portion respective channel and spline;

means adaptably connected to said first and second collar portions for support thereof on a grass track post or a dirt racetrack post; and, rail means adaptably formed for connection to said collar means.

* * * * *